US006863540B2

(12) United States Patent
Spykerman

(10) Patent No.: US 6,863,540 B2
(45) Date of Patent: Mar. 8, 2005

(54) DUAL CONTACT ELECTRICAL COMPRESSION CONNECTOR

(75) Inventor: Conway Francis Spykerman, Singapore (SG)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/714,149

(22) Filed: Nov. 14, 2003

(65) Prior Publication Data

US 2004/0137765 A1 Jul. 15, 2004

(30) Foreign Application Priority Data

Nov. 18, 2002 (SG) ..... 200206980-5

(51) Int. Cl.[7] ..... H01R 12/00
(52) U.S. Cl. ..... 439/66; 439/907; 439/862
(58) Field of Search ..... 439/65, 66, 907, 439/862, 71

(56) References Cited

U.S. PATENT DOCUMENTS 3,941,442 A * 3/1976 Friend ..... 439/862
3,977,757 A * 8/1976 Yurtin ..... 439/852
5,437,556 A * 8/1995 Bargain et al. ..... 439/66
5,588,844 A * 12/1996 Sipe ..... 439/65
5,885,090 A * 3/1999 Comstock et al. ..... 439/65
6,004,140 A * 12/1999 Kato et al. ..... 439/65
6,039,601 A * 3/2000 Kraiczyk et al. ..... 439/500
6,077,130 A * 6/2000 Hughes et al. ..... 439/862
6,123,553 A * 9/2000 Kobayashi et al. ..... 439/77
6,302,727 B1 * 10/2001 Fedorjaka ..... 439/500
6,315,621 B1 * 11/2001 Natori et al. ..... 439/862
6,719,567 B2 * 4/2004 Billman et al. ..... 439/65

* cited by examiner

*Primary Examiner*—Ross Gushi
(74) *Attorney, Agent, or Firm*—Harrington & Smith, LLP

(57) ABSTRACT

An electrical connector to make an electrical connection between a first electrical device and an electrical trace of a circuit of a second electrical device. The first electrical device is of a kind which includes two surfaces, the planes of which are not parallel to each other. A first of the two surfaces has disposed thereon a first conductive pad region and a second of the two surfaces has disposed thereon a second conductive pad region. The first and second conductive pad regions are in electrical connection with each other. The electrical connector includes a housing, at least one conductive element, and, which includes a first contact region for engagement with the first conductive pad region, a second contact region for engagement with the second conductive pad region, and a third contact region to make contact with the electrical trace of the second electrical device.

16 Claims, 3 Drawing Sheets

DUAL CONTACT ELECTRICAL COMPRESSION CONNECTOR

FIELD OF INVENTION

The present invention relates to an electrical compression connector, which for example may provide electrical connection between two electrical devices commonly found in electronic devices. This DCEC (Dual Contact Electrical Compression) connector is designed with the intention to eliminate electrical discontinuity under extreme vibration or shock at sudden impact.

BACKGROUND

Compression connectors of many different kinds are well known. Connectors, which are used in high-density applications to connect electrical traces of two separate devices, are also well known. A very common kind of such a connector is called a compression connector wherein a leg of a conductive element is able to deflect under the compression of an electrical device whilst simultaneously making contact with an electrical trace of such an electrical device. A separate region of such a conductive element will be or is made to be engaged to another electrical device to establish a flow of electrical signals between the two devices. A leg of the conductive element with which an electrical device is able to engage is deflected from its natural design state by the relative movement between the leg and the electrical device during compression. Normally the electrical device is a printed circuit board or card and is removable or can be disengage from the connector. The relative movement may be such that the legs are being compressed by fastening the electrical device relative to the connector while the latter remains static in place or the connector floats & sandwiched between two fastened electrical device or boards. Alternatively the electrical device may slide relative to the leg but also a component of movement occurs in the compression direction. The ultimate form of connection that is made in either modes of engagement are the same except one has been established by a sliding compression whereas other has been established by a pure compressive engagement. The item with which electrical components are engaged may often be subjected to shock or vibration. Since the arms of the conductive elements are resiliently moveable, such shock or vibration may be sufficient for the conductive element to become disengaged with the electrical component against which it is resiliently biased. The item may for example be a mobile phone or other consumer product, which may on occasion be dropped by a user and the impact of the item with the ground, may be sufficient to cause for such a connector to become disconnected with its respective electrical device. The shock loading is likely to occur in each instance in one direction and should this direction coincide with the direction of resilient movement of the leg the conductive element the leg may move relative to the electrical device and may hence become disconnected.

Accordingly it is an object of the present invention to provide an electrical compression connector which overcomes the above mentioned disadvantage or which will at least provide the public with a useful choice.

BRIEF DESCRIPTION OF THE INVENTION

In a first aspect the present invention consists in an electrical connector to make an electrical connection between a first electrical device and an electrical trace of a circuit of a second electrical device, said first electrical device being of a kind which includes two surfaces the planes of which are not parallel to each other, wherein a first of said two surfaces has disposed thereon a first conductive pad region and a second of said two surfaces has disposed thereon a second conductive pad region wherein said first and second conductive pad regions are in electrical connection with each other, said electrical connector comprising:

- a housing
- at least one conductive element carried by said housing and which includes
  - a first contact region for engagement with said first conductive pad region,
  - a second contact region for engagement with said second conductive pad region, and
  - a third contact region to make contact with said electrical trace of said second electrical device to create an electrical connection thereof with said first and second conductive pad regions
- the conductive element(s) carried by said housing to present at least said first contact region in a resiliently movable for compressive engagement with said first conductive pad region and said second contact region in a resiliently movable manner for compressive engagement with said second pad region, each of said first and second contact regions being movable in a direction away from but resiliently biased towards the respective pad regions with which said contact regions are to engage Preferably said first contact region is deflectable relative to said housing along a path which is not parallel to the path along which said second contact region is deflectable relative to said housing.

Preferably the path along which said first contact region is resiliently movable is substantially transverse to the path along which said second contact region is resiliently movable.

Preferably the path along which said first contact region is resiliently movable is substantially at perpendicular to the path along which said second contact region is resiliently movable.

Preferably said conductive element includes of a fixing region which is engaged to the housing in a secure manner and has dependent therefrom (a) a first leg which includes at or towards a region distal from said fixing region, said first contact region and (b) a second leg which includes at or towards a region distal from said fixing region, said second contact region, said legs being disposed in a resiliently movable manner from said fixing region.

Preferably first contact region is positioned by said first leg to become engaged with said first conductive pad region in a manner wherein said first conductive pad is pressed onto said first contact region with negligible movement of said first contact region in a direction over the first conductive pad region and said second contact region is positioned by said second leg to become engaged with said second conductive pad region in a compressive manner with movement of said second contact region in a direction over the second conductive pad region.

Preferably a first electrical device holding means is provided in a fixed relationship to said housing, said holding means able to receive at least part of said second electrical device in a manner so as to hold it in a relationship wherein the first and second contact regions are in a compressive engagement with respective first and second conductive pad regions.

Preferably said first electrical device holding means is able to receive at least part of said first electrical device in a manner such that said first conductive pad region is able to advance towards engagement with said first contact region is a direction parallel to the direction of the path of resilient movement of said first contact region, and said second conductive pad region is able to advance for engagement with said second contact region in a manner to slide relative thereto, the advancement also inducing a movement of said second contact region in a direction along said path of resilient movement thereof.

Preferably said second leg includes a section thereof sloping relative to the path of deflection of said second contact region, and which provides a ramp along which said second surface is able to travel in non parallel direction to thereby displace said second contact region along its path of resilient movement during engagement of said first electrical device therewith.

Preferably said first and second contact are each movable along a path lying in a plane wherein the plane of said first leg is parallel to the plane of the second leg.

Preferably said housing is affixed to the said second electrical device in a permanent manner and is able to receive said first electrical device engaged thereto in a releasable manner.

Preferably said housing has a plurality of said conductive elements spaced apart in an array to each have their respective first and second contact regions engage with a corresponding first and second conductive pad regions.

Preferably the shape of the conductive element is defined by out plane folding from a stamped sheet metal material.

In a second aspect the present invention consists in an electrical connector formed of a sheet metal material, to provide electrical connection between an electrical trace of a PCB and an electrical trace of a second electrical device said electrical connector comprising a first contact region provided on or carried by a first leg which extends from a mounted or mounting section engaged or to be engaged to the second electrical device, said first contact region displaceable in a resilient manner relative to said mounted or mounting section in a direction along a first path during such engagement thereof by a first surface of a PCB, a second contact region provided on or carried by a second leg which extends from said mounted or mounting section, said second contact region displaceable in a resilient manner relative to said mounted or mounting section in a direction along a second path during such engagement thereof by a second surface of a PCB, the first path being perpendicular to the second path a third contact region engaged or engagable for electrical connection to the electrical trace of said second device wherein said electrical connector is able to make a two point contact with said electrical trace of said PCD which is provided in part on each of said first and second surfaces to establish at least in part, two flow paths for electricity between said electrical trace of said PCB and said electrical trace of second electrical device.

In a further aspect the present invention consists in a connector to provide interconnection between a first and second electrical devices which each present electrical connection points between which said connector is to provide electrical connection, said connector comprising, a housing carrying at least one conductive element, said conductive element which includes a first, second and a base contact region, the said first and second contact region provided on respective legs of said connector which extend in a direction away from said base contact region;

the first contact region is deflectably movable relative to the said housing in a first direction and the second contact region is deflectably movable relative to said housing in a second direction which is perpendicular to the first direction;

wherein said first and second contact regions are to engage and connect in a compressive manner to respective conductive traces of the said first electrical device which are provided on surfaces thereof which are substantially normal to the direction of deflection of the respective contact regions and are electrically connected with each other on said first electrical device.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

DETAILED DESCRIPTION OF THE INVENTION

Figure 1:
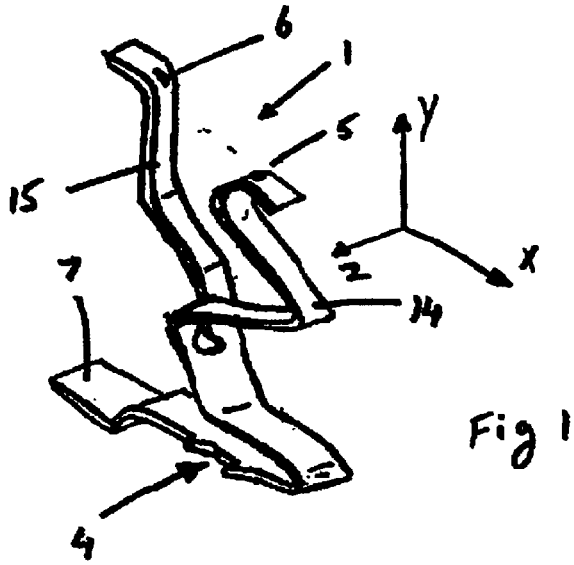
FIG. 1 is a perspective view of a conductive element in a preferred form of the present invention.
Figure 3:
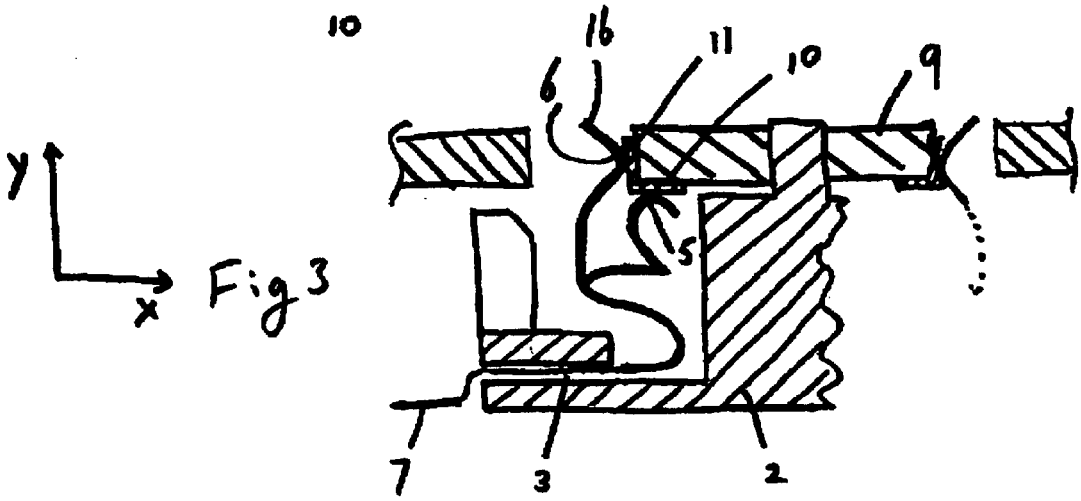
FIG. 3 is a sectional view through a housing that carries a conductive element and wherein the relationship of conductive connection between the conductive element and a first electrical device has been shown.

With reference to FIG. 1 there is shown a conductive element 1. The conductive element 1 is of a compression connection kind meaning that at least one electrical device with which the conductive element is to make an electrical connection with, is under compression, thereby in a manner such that a portion of the conductive element 2 is resiliently deflected. The conductive element 1 as shown in FIG. 1 may for example be engaged to a housing 2 which carries the conductive element relative to a first 9 and second electrical device 8. The housing may be mounted for example to a second electrical device and the first electrical device 9 is movable relative thereto so as to allow it to establish a compression connection with the conductive element 1. FIG. 3 shows a housing 2 with which a conductive element 1 is engaged at the region 3. At region 3, the conductive element 1 remains substantially stationary relative to the housing 2. A barbed section 4 of the conductive element 2 may be provided to aid in the retention of the conductive element 1 at region 3 to the housing 2. A person skilled in the art will however appreciate that many alternative forms of engagement of a conductive element 1 to a housing 2 exist. Indeed for some conductive elements such engagement may be free floating to a certain extent.

The housing 2 may retain a plurality of conductive elements in an array. Such plurality of conductive elements would be spaced apart in the Z direction to effectively form an array of conductive elements (not shown) presented by the housing.

The conductive element 1 as shown in FIGS. 1 and 3, includes a first and second contact regions 5, 6. A third contact region 7 is provided for engagement to a second electrical device. The third contact region 7 of the conductive element may be permanently engaged to a lead, trace or pad (hereinafter referred to as "conductive pad region") of the second electrical device or to electrical wiring of a second electrical device. Such connection may be by soldering or alternatively by a compression connection or similar. The second electrical device 8 may for example be a printed circuit board and the housing 2 may also be mounted to the printed circuit board in a fixed relationship. Alternatively and with reference to for example FIG. 5, the third contact region 7 is engaged to a second electrical device 8 in a compression connection manner and the conductive element itself is engaged to another portion of the overall device with which the first and second electrical devices are or are to locate with.

Figure 4:
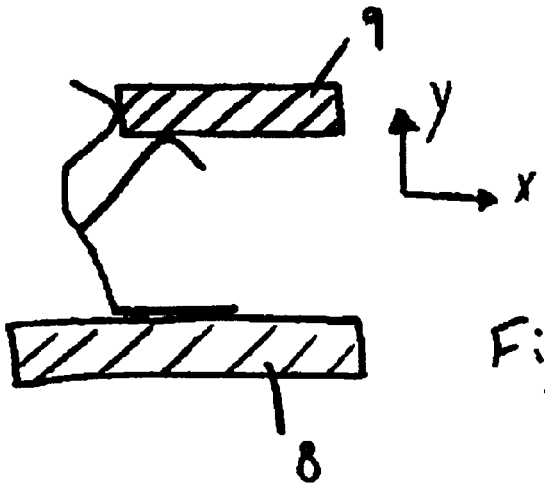
FIG. 4 is a sectional view through a first and second electrical device (wherein a housing is not shown) wherein the conductive element makes an electrical connection with the first and second conductive pad regions of a first electrical device and makes conductive connection with a second device the connection therewith being substantially non-compressive.

In an alternative form, the conductive element may be permanently fixed directly to the second electrical device 8 as for example shown in FIG. 4. Such a permanent connection may be made by soldering or by other or additional means of fastening. However such is not preferred as the conductive elements are preferably provided as part of a unit which includes a mountable housing. FIG. 4 is an illustrative view of such an alternative embodiment wherein the third contact region is secured directly to the second electrical device however this need not be the most desired form of connection of the conductive element with the second electrical device 8. The first and second contact regions (5, 6) of the conductive element is preferably made from a sheet metal which has been stamped to a form from which it can be folded to define the desired shape. The desired shape of the folded conductive element presents the first and second conductive regions (5, 6) in a manner so that each can make contact with a first 10 and second 11 conductive pad region of the first electrical device 9.

Such first and second conductive pad regions 10, 11 are engaged by the first and second contact regions where the surface of the pads project in directions which are preferably substantially perpendicular to each other. The first and second conductive pad regions 10, 11 are hence engaged onto surfaces of the first electrical device which are substantially perpendicular to each other. This can for example be seen in FIGS. 2-6. The first surface 12 may for example be one of the major surfaces of the first electrical device (when for example the first electrical device is a printed circuit board). The first conductive pad region 10 extends on part of the major surface 12 in a region such that the first contact region of the conductive element can engage therewith. During compression, the deflection of the first contact region 5 is in a direction along the path of the Y-axis. This is the direction in which the first electrical device 9 becomes engaged with the conductive element. A compression of the first contact region 5 occurs relative to the fixed portion 4 of the conductive element and relative to the housing 2 as such engagement occurs. The first contact region 5 will thereby be biased in an opposite direction along the path of the Y-axis and be pressed against the first conductive pad region 10 of the first electrical device 9. The first contact region 5 is provided by the conductive element in a manner to be deflectable along a path in the Y axis direction by being disposed at or towards the end of a leg 14 of the conductive element. As can be seen with reference to FIG. 1, a preferred form of the conductive element is bifurcated to provide a first leg 14 which includes the first contact region 5 and a second leg 15 which includes the second contact region 6 preferably provided at or towards the distal end of the second leg 15. The legs extend from the remainder of the conductive element such that their engagement with the first electrical device induces a deflection and are appropriately biased back towards the first electrical device due bending strength, the shape and size of the legs/conductive elements.

During engagement of the first electrical device 9 with the conductive element, the first contact region 5 is displaced along a path substantially in the Y direction. The second leg 15 is configured such that during the movement of the first electrical device along a path in the Y direction. The second contact region will be displaced along a path, which is extending substantially in the X-axis. Preferably the leg 6 includes a lip 16 which acts as a cam surface which can be displaced by the surface 13 of the first electrical device as it is moved along a path in the Y direction for engagement with the conductive element. This lip 16 being angled upwardly non-parallel to the Y direction and away from the electrical device will allow for a sliding engagement of the second contact region 6 to be established and simultaneously move the second contact region 6 along a path in the X direction. When fully engaged, the second contact region will be biased towards the second conductive pad region 11 of the first electrical device 9. Such biasing is in the X direction, perpendicular to the direction of bias of the first contact region.

Figure 2:
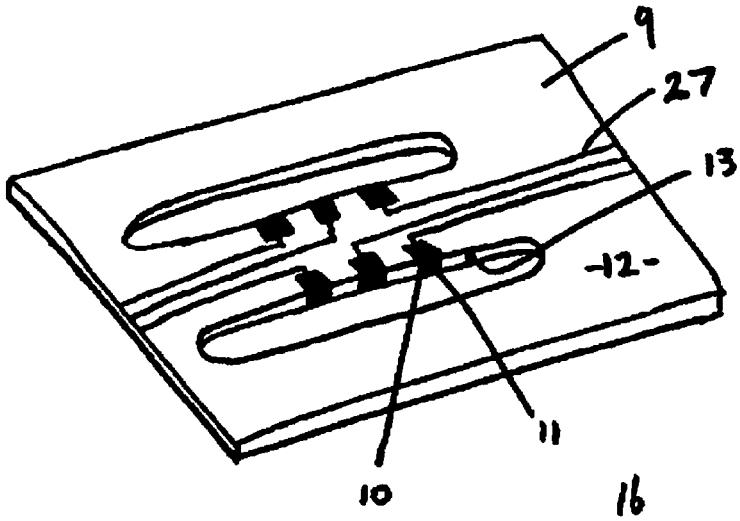
FIG. 2 is a perspective view of a first electrical device showing a plurality of first and second conductive pad regions with each of which a separate conductive element is made to engage.

The first and second conductive pad regions (10, 11) are preferably positioned at regions of the surfaces (12, 13) of the first electrical device which are proximate to each other. Preferably such regions are adjacent to each other and indeed the first and second conductive pad regions (10, 11) are in direct electrical contact with each other. This can for example seen in FIGS. 2 and 3 wherein the first and second conductive pad regions have been formed to extend about the edge between the surfaces 12 and 13. However it will be appreciated that although the first and second conductive pad regions are to be in electrical connection with each other, such need not necessarily be provided in such a direct manner. With reference to FIG. 2 it can be seen that electrical leads 27 of the printed circuit board 9 extend away from the conductive pad regions 10 to extend to other regions (not shown) for appropriate purposes. In the preferred configuration the housing can provide an array of conductive elements and allows a printed circuit board 9 to engage with the housing (and perhaps other components of the overall device) to mount the printed circuit board 9 with the housing and thereby engage each first and second conductive pad regions of each array with a respective first and second contact region 5, 6 of a respective conductive element. Each conductive element thereby makes a two point electrical contact with a circuit of the printed circuit board with the first and second conductive pad regions (10, 11). The direction of bias of each of the first and second contact regions (5, 6) is in a different direction (and preferably in a perpendicular direction). Any shock loading which occurs, and which commonly occurs from one direction, may result in one of the contact regions from becoming dislodged with a respective conductive pad region. However since the direction will not be parallel or near parallel to the direction of a deflection of the other contact region, the other contact region will remain in contact with its respective conductive pad region.

The deflection of both the first and second contact regions 5, 6 occurs in the X-Y plane, which is the plane within which the formation of the conductive element by out of plane folding has occurred. Substantially all of the major surfaces of the conductive element are and remain substantially parallel to the Z direction and the conductive element takes up little space out of the X-Y plane which is an advantage when the element is used in a high density application.

In the form as shown in FIGS. 2 and 3 where two arrays of conductive elements are provided, the first electrical device may purely move in a path along the Y direction for engagement with the conductive element. The PCB may have two holes (preferably elongate holes) therein to each provide a minor edge surface 13 at which a series of the second conductive pad regions can be provided as shown in FIG. 2. The second contact regions are positioned to bias towards each other. The configuration may alternatively provide one hole where along two opposing edges of the hole the two arrays of conductive elements may respectively engage. In such a configuration the second contact regions would be biased away from each other.

Figure 5:
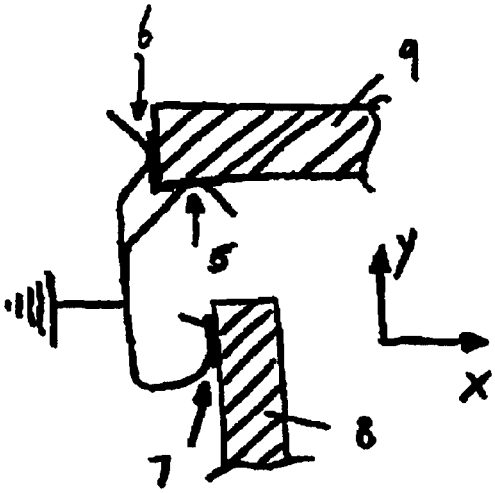
FIG. 5 illustrates a sectional view wherein the conductive element is mounted stationary relative to another component of the overall assembly and is in compressive engagement with both the first electrical device and second electrical device.
Figure 6:
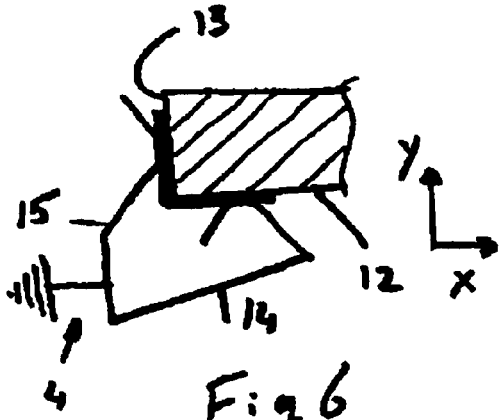
FIG. 6 illustrates yet an alternative embodiment of the conductive element of the present invention
Figure 7:
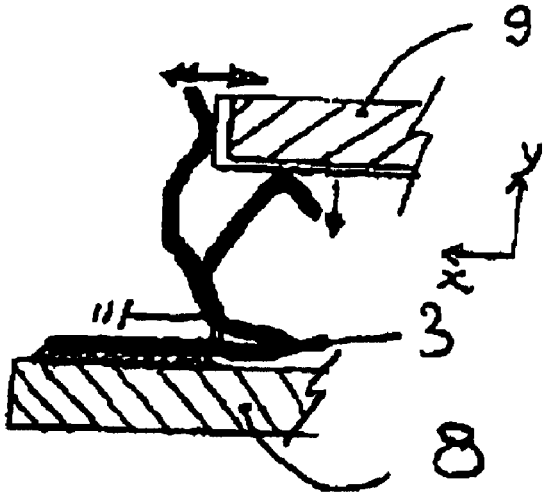
FIG. 7 illustrates that the conductive element of FIG. 4 can be housed in a housing as well.
Figure 8:
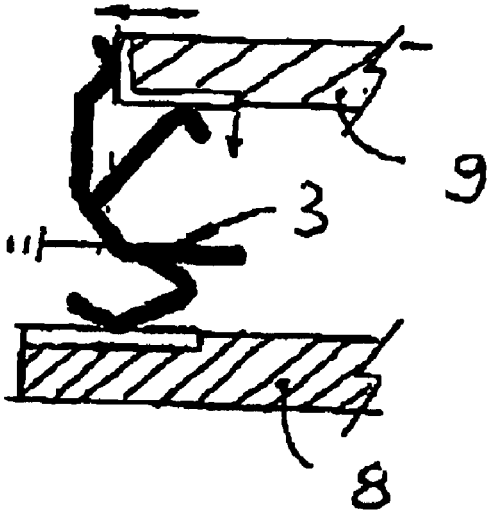
FIG. 8 shows how a mounting feature of this configuration can be mounted with a housing and present a double compression connector.
Figure 9:
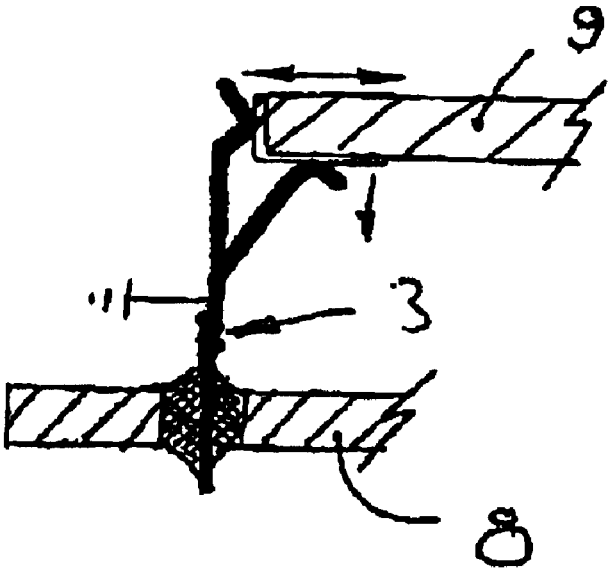
FIG. 9 shows a through mount connection with a second electrical device.

In yet another alternative form the movement of the first electrical device may be along a path in the X direction or in a direction which has both X and Y direction components of movement. With reference to FIGS. 1, 4 and 5, the bifurcation of the conductive element to define the two legs occurs from one side of the base region 4 of the conductive element. However with reference to FIG. 6, the bifurcation may be provided to result in the legs 14 and 15 extending in opposite directions from the base 4. The conductive element is preferably of a copper alloy.

The engagement established enables continuous electrical flow significantly reducing if not eliminating any chance of an open circuit under extreme vibration or shock under impact.

What is claimed is:

1. An electrical connector to make an electrical connection between a first electrical device and an electrical trace of a circuit of a second electrical device, said first electrical device being of a kind which includes two surfaces the planes of which are not parallel to each other, wherein a first of said two surfaces has disposed thereon a first conductive pad region and a second of said two surfaces has disposed thereon a second conductive pad region wherein said first and second conductive pad regions are in electrical connection with each other, said electrical connector comprising:

a housing at least one conductive element carried by said housing and which includes:

a first contact region for engagement with said first conductive pad region, a second contact region for engagement with said second conductive pad region, and a third contact region to make contact with said electrical trace of said second electrical device to create an electrical connection thereof with said first and second conductive pad regions wherein the conductive element(s) is carried by said housing to present at least said first contact region in a resiliently movable manner for compressive engagement with said first conductive pad region and said second contact region in a resiliently movable manner for compressive engagement with said second pad region, each of said first and second contact regions being movable in a direction away from but resiliently biased towards the respective pad regions with which said contact regions are to engage, wherein a deflectable section of the at least one conductive element is located between the third contact region and the first and second contact regions, and wherein portions of the at least one conductive element having the first and second contact regions extend separately directly from the deflectable section.

2. An electrical connector as claimed in claim 1 wherein said first contact region is deflectable relative to said housing along a path which is not parallel to the path along which said second contact region is deflectable relative to said housing.

3. An electrical connector as claimed in claim 1 wherein the path along which said first contact region is resiliently movable is substantially transverse to the path along which said second contact region is resiliently movable.

4. An electrical connector as claimed in claim 1 wherein the path along which said first contact region is resiliently movable, is substantially perpendicular to the path along which said second contact region is resiliently movable.

5. An electrical connector as claimed in claim 1 wherein the shape of the conductive element is defined by out plane folding from a stamped sheet metal material.

6. An electrical connector as claimed in claim 1 wherein the portions of the at least one conductive element comprise a first deflectable leg having the first contact region thereon and a second separately deflectable leg having the second contact region thereon.

7. An electrical connector as claimed in claim 1 wherein said conductive element includes of a fixing region which is engaged to the housing in a secure manner and has dependent therefrom (a) a first leg which includes at or towards a region distal from said fixing region, said first contact region and (b) a second leg which includes at or towards a region distal from said fixing region, said second contact region, said legs being disposed in a resiliently movable manner from said fixing region.

8. An electrical connector as claimed in claim 7 wherein first contact region is positioned by said first leg to become engaged with said first conductive pad region in a manner wherein said first conductive pad is pressed onto said first contact region with negligible movement of said first contact region in a direction over the first conductive pad region and said second contact region is positioned by said second leg to become engaged with said second conductive pad region in a compressive manner with movement of said second contact region in a direction over the second conductive pad region.

9. An electrical connector as claimed in claim 7 wherein said first and second contact regions are each movable along a path lying in a plane wherein the plane of said first leg is parallel to the plane of the second leg.

10. An electrical connector to make an electrical connection between a first electrical device and an electrical trace of a circuit of a second electrical device, said first electrical device being of a kind which includes two surfaces the planes of which are not parallel to each other, wherein a first of said two surfaces has disposed thereon a first conductive pad region and a second of said two surfaces has disposed thereon a second conductive pad region wherein said first and second conductive pad regions are in electrical connection with each other, said electrical connector comprising:

a housing at least one conductive element carried by said housing and which includes:

a first contact region for engagement with said first conductive pad region, a second contact region for engagement with said second conductive pad region, and a third contact region to make contact with said electrical trace of said second electrical device to create an electrical connection thereof with said first and second conductive pad regions wherein the conductive element(s) is carried by said housing to present at least said first contact region in a resiliently movable manner for compressive engagement with said first conductive pad region and said second contact region in a resiliently movable manner for compressive engagement with said second pad region, each of said first and second contact regions being movable in a direction away from but resiliently biased towards the respective pad regions with which said contact regions are to engage, wherein a first electrical device holding means is provided in a fixed relationship to said housing, said holding means able to receive at least part of said second electrical device in a manner so as to hold it in a relationship wherein the first and second contact regions are in a compressive engagement with respective first and second conductive pad regions.

11. An electrical connector as claimed in claim 10 wherein said first electrical device holding means is able to receive at least part of said first electrical device in a manner such that said first conductive pad region is able to advance towards engagement with said first contact region is a direction parallel to the direction of the path of resilient movement of said first contact region, and said second conductive pad region is able to advance for engagement with said second contact region in a manner to slide relative thereto, the advancement also inducing a movement of said second contact region in a direction along said path of resilient movement thereof.

12. An electrical connector to make an electrical connection between a first electrical device and an electrical trace of a circuit of a second electrical device, said first electrical device being of a kind which includes two surfaces the planes of which are not parallel to each other, wherein a first of said two surfaces has disposed thereon a first conductive pad region and a second of said two surfaces has disposed thereon a second conductive pad region wherein said first and second conductive pad regions are in electrical connection with each other, said electrical connector comprising:

a housing at least one conductive element carried by said housing and which includes:

a first contact region for engagement with said first conductive pad region, a second contact region for engagement with said second conductive pad region, and a third contact region to make contact with said electrical trace of said second electrical device to create an electrical connection thereof with said first and second conductive pad regions wherein the conductive element(s) is carried by said housing to present at least said first contact region in a resiliently movable manner for compressive engagement with said first conductive pad region and said second contact region in a resiliently movable manner for compressive engagement with said second pad region, each of said first and second contact regions being movable in a direction away from but resiliently biased towards the respective pad regions with which said contact regions are to engage, wherein said conductive element includes of a fixing region which is engaged to the housing in a secure manner and has dependent therefrom (a) a first leg which includes at or towards a region distal from said fixing region, said first contact region and (b) a second leg which includes at or towards a region distal from said fixing region, said second contact region, said legs being disposed in a resiliently movable manner from said fixing region, wherein said second leg includes a section thereof sloping relative to the path of deflection of said second contact region, and which provides a ramp along which said second surface is able to travel in non parallel direction to thereby displace said second contact region along its path of resilient movement during engagement of said first electrical device therewith.

13. An electrical connector to make an electrical connection between a first electrical device and an electrical trace of a circuit of a second electrical device, said first electrical device being of a kind which includes two surfaces the planes of which are not parallel to each other, wherein a first of said two surfaces has disposed thereon a first conductive pad region and a second of said two surfaces has disposed thereon a second conductive pad region wherein said first and second conductive pad regions are in electrical connection with each other, said electrical connector comprising:

a housing at least one conductive element carried by said housing and which includes:

a first contact region for engagement with said first conductive pad region, a second contact region for engagement with said second conductive pad region, and a third contact region to make contact with said electrical trace of said second electrical device to create an electrical connection thereof with said first and second conductive pad regions wherein the conductive element(s) is carried by said housing to present at least said first contact region in a resiliently movable manner for compressive engagement with said first conductive pad region and said second contact region in a resiliently movable manner for compressive engagement with said second pad region, each of said first and second contact regions being movable in a direction away from but resiliently biased towards the respective pad regions with which said contact regions are to engage, wherein said housing is affixed to said second electrical device in a permanent manner and is able to receive said first electrical device engaged thereto in a releasable manner.

14. An electrical connector to make an electrical connection between a first electrical device and an electrical trace of a circuit of a second electrical device, said first electrical device being of a kind which includes two surfaces the planes of which are not parallel to each other, wherein a first of said two surfaces has disposed thereon a first conductive pad region and a second of said two surfaces has disposed thereon a second conductive pad region wherein said first and second conductive pad regions are in electrical connection with each other, said electrical connector comprising:

a housing at least one conductive element carried by said housing and which includes:

a first contact region for engagement with said first conductive pad region, a second contact region for engagement with said second conductive pad region, and a third contact region to make contact with said electrical trace of said second electrical device to create an electrical connection thereof with said first and second conductive pad regions wherein the conductive element(s) is carried by said housing to present at least said first contact region in a resiliently movable manner for compressive engagement with said first conductive pad region and said second contact region in a resiliently movable manner for compressive engagement with said second pad region, each of said first and second contact regions being movable in a direction away from but resiliently biased towards the respective pad regions with which said contact regions are to engage, wherein said housing has a plurality of said conductive elements spaced apart in an array to each have their respective first and second contact regions engage with a corresponding first and second conductive pad regions of a single PCB.

15. An electrical connector formed of a sheet metal material, to provide electrical connection between an electrical trace of a PCB and an electrical trace of a second electrical device said electrical connector comprising a first contact region provided on or carried by a first leg which extends from a mounted or mounting section engaged or to be engaged to the second electrical device, said first contact region displaceable in a resilient manner relative to said mounted or mounting section in a direction along a first path during such engagement thereof by a first surface of a PCB, a second contact region provided on or carried by a second leg which extends from said mounted or mounting section, said second contact region displaceable in a resilient manner relative to said mounted or mounting section in a direction along a second path during such engagement thereof by a second surface of a PCB, the first path being perpendicular to the second path a third contact region engaged or engagable for electrical connection to the electrical trace of said second device wherein said electrical connector is able to make a two point contact with said electrical trace of said PCB which is provided in part on each of said first and second surfaces to establish at least in part, two flow paths for electricity between said electrical trace of said PCB and said electrical trace of second electrical device, wherein the first leg and the second leg extend from a common deflectable section which extends directly from said mounted or mounting section.

16. A connector to provide interconnection between a first and second electrical devices which each present electrical connection points between which said connector is to provide electrical connection, said connector comprising, a housing carrying at least one conductive element, said conductive element which includes a first, second and a base contact region, the said first and second contact region provided on respective legs of said connector which extend in a direction away from said base contact region;

the first contact region is deflectably movable relative to the said housing in a first direction and the second contact region is deflectably movable relative to said housing in a second direction which is perpendicular to the first direction, wherein the legs of the first and second contact re ions extend from a common deflectable section located between the base contact region and the legs of the first and second contact regions;

wherein said first and second contact regions are to engage and connect in a compressive manner to respective conductive traces of the said first electrical device which are provided on surfaces thereof which are substantially normal to the direction of deflection of the respective contact regions and are electrically connected with each other on said first electrical device.

* * * * *

UNITED STATES PATENT AND TRADEMARK OFFICE

CERTIFICATE OF CORRECTION

PATENT NO. : 6,863,540 B2
DATED : March 8, 2005
INVENTOR(S) : Spykerman, Conway F.

It is certified that error appears in the above-identified patent and that said Letters Patent is hereby corrected as shown below:

Column 12,
Line 34, delete "re ions" and replace with -- regions --.

Signed and Sealed this

Thirty-first Day of May, 2005

JON W. DUDAS
*Director of the United States Patent and Trademark Office*